US012605594B2

(12) United States Patent
Park

(10) Patent No.: US 12,605,594 B2
(45) Date of Patent: Apr. 21, 2026

(54) GOLF SWING PRACTICE MACHINE

(71) Applicant: DMBH CO., LTD., Bucheon-si (KR)

(72) Inventor: Yong Gil Park, Seongnam-si (KR)

(73) Assignee: DMBH CO., LTD., Bucheon-si (KR)

( * ) Notice: Subject to any disclaimer, the term of this patent is extended or adjusted under 35 U.S.C. 154(b) by 306 days.

(21) Appl. No.: 18/563,878

(22) PCT Filed: Mar. 15, 2022

(86) PCT No.: PCT/KR2022/003564
§ 371 (c)(1),
(2) Date: Nov. 23, 2023

(87) PCT Pub. No.: WO2022/255605
PCT Pub. Date: Dec. 8, 2022

(65) Prior Publication Data

US 2024/0367003 A1 Nov. 7, 2024

(30) Foreign Application Priority Data

Jun. 4, 2021 (KR) ..... 10-2021-0072778

(51) Int. Cl.
*A63B 24/00* (2006.01)
*A63B 69/36* (2006.01)

(52) U.S. Cl.
CPC ..... *A63B 24/0062* (2013.01); *A63B 69/3614* (2013.01); *A63B 2024/0071* (2013.01); *A63B 2220/44* (2013.01); *A63B 2220/805* (2013.01)

(58) Field of Classification Search
CPC . A63B 69/36; A63B 69/3614; A63B 69/3632; A63B 69/3661; A63B 2220/805; A63B 2220/833
See application file for complete search history.

(56) References Cited

U.S. PATENT DOCUMENTS 4,979,745 A * 12/1990 Kobayashi ..... A63B 69/36 473/222
5,374,063 A * 12/1994 Ogden ..... A63B 69/3614 473/220
8,109,816 B1 2/2012 Grober

FOREIGN PATENT DOCUMENTS

| | | | | |
|---|---|---|---|---|
| CN | 204734935 | U | * | 11/2015 |
| JP | 06-304283 | A | | 11/1994 |
| JP | H06304283 | A | * | 11/1994 |
| JP | 2016049231 | A | * | 4/2016 |
| KR | 20-0410215 | Y1 | | 3/2006 |
| KR | 10-0832098 | B1 | | 5/2008 |

(Continued)

OTHER PUBLICATIONS

Office Action of Japanese Patent Application No. 2023-574672 dated Nov. 12, 2024.

(Continued)

*Primary Examiner* — Steven J Hylinski
(74) *Attorney, Agent, or Firm* — Revolution IP, PLLC

(57) ABSTRACT

According to the present invention, a golf swing practice machine is provided, the golf swing practice machine including: a club part (100) which enables a golfer to take a swing; a bottom part (200) on which a golf ball to be struck by a swing of the club part is placed; and an application (300) which may evaluate the state of the club part or select the type of a practice club when the golf ball placed on the bottom part (200) is struck, and thus, a swing state of the club part (100) may be analyzed.

10 Claims, 10 Drawing Sheets

(56) References Cited

FOREIGN PATENT DOCUMENTS

| | | | |
|---|---|---|---|
| KR | 10-2009-0129246 | A | 12/2009 |
| KR | 10-1048211 | B1 | 7/2011 |
| KR | 10-2011-0119026 | A | 11/2011 |
| KR | 10-1507569 | B1 | 4/2015 |
| KR | 10-2017-0011229 | A | 2/2017 |
| KR | 10-1728144 | B1 | 4/2017 |
| KR | 10-1848999 | B1 | 4/2018 |
| KR | 10-2053564 | B1 | 12/2019 |

OTHER PUBLICATIONS

International Search Report of PCT/KR2022/003564 mailed Sep. 8, 2022 from Korean Intellectual Property Office.

* cited by examiner (a) Underside of club part (b) Plan view of bottom part (a) Face angle state (b) Face angle measurement example (a) View in direction of A of FIG. 1

(b) Front view of FIG. 1

(c) View of underside of head unit FIG. 8

GOLF SWING PRACTICE MACHINE

TECHNICAL FIELD

The present invention relates to a golf swing practice machine, more specifically to a golf swing practice machine that is capable of allowing a golfer to practice golf swings, while he or she does not strike a golf ball indoors and outdoors, to thus correct a posture in his or her golf swing.

BACKGROUND ART

Generally, golf is a game in which a golfer strikes a golf ball with various clubs into a series of holes on a course, and in golf, it is necessary to take a right posture when the golfer strikes (impacts) the golf ball.

A golf swing is aimed to strike a golf ball accurately in a desired distance and direction, while a golf club head is moving along a specific trajectory, and for a right golf swing, it is very important that a golfer takes a series of postures for his or her golf swing (address, backswing, backswing top, downswing, impact, follow-through, and finish).

Golf widely spreads as one of the most popular sports and is recognized as such a sport that provides many advantages in improving a player's physical and mental health.

To practice golf swings, golfers visit indoor practice fields, screen golf courses, and the like, which undesirably causes inconveniences and costs of such visits.

Further, as golf is a sport played outside, it is greatly influenced by the weather, and accordingly, it is hard to play golf on rainy or windy weather. Because of such reasons, a variety of golf practice machines are developed and introduced, and such golf practice machines are configured to install a net type bag on the front surface thereof so that a golfer strikes a golf ball with a golf club really used by the golfer, thereby practicing his or her swing posture and striking.

Recently, various methods and devices have been suggested to enable a golfer to practice his or her golf swing even on a small space such as a house, office room, and the like.

Conventional golf swing practice machines are disclosed in Korean Patent No. 10-1507569, Korean Patent No. 10-0832098, Korean Patent No. 10-1048211, and Korean Utility Model Registration No. 20-0410215, which disclose methods and devices wherein a moving body is mounted on a practice club to generate a strike sound and a constraining force of the moving body is adjusted according to golf swing speed.

Such conventional golf swing practice methods enable a golfer to practice extremely limited elements among various elements such as a swing speed (a club speed), a club path, a club face angle, an attack angle, and the like that are connected to swing results. Actually, the moment of impact is important in the golf swing, but the moment when the moving body escapes to thus generate the strike sound may occur in a large range on a downswing trajectory.

Further, another conventional golf swing practice method and device is disclosed in Korean Patent No. 10-1848999 wherein a laser beam is installed on a practice club and a plurality of golf balls are printed or placed on a mat so that the golf balls are selected to practice golf swings according to types of clubs, while the golf balls are not struck directly by a golfer indoors. However, such a conventional method and device does not sense the moment of impact in the golf swing, and accordingly, the conventional method and device is simply utilized in practicing the posture at golf swing address.

As a MEMS technology has been developed, recently, there are proposed swing analysis devices and methods in which an acceleration sensor, a gyroscope sensor, and a geomagnetic sensor are built in a private club shaft or attached to the club shaft used by a golfer to analyze a swing trajectory or elements related to the swing.

Another conventional golf swing practice machine is disclosed in Korean Patent No. 10-1728144 wherein a swing trajectory is found by using an acceleration sensor and then compared with pre-stored data and according to the compared value, a pre-stored sound is generated. However, in this case, only the swing trajectory is used in practicing golf swings.

Another conventional golf swing practice machine is disclosed in Korean Patent No. 10-2053564 wherein an acceleration sensor, a gyroscope sensor, and a distortion sensor as a MEMS sensor are attached to a club shaft, and when a golfer really strikes a golf ball, a head speed, a lie angle, and a face angle are analyzed and provided. However, the golf ball has to be directly struck by the golfer.

Further, a swing analysis method is disclosed in U.S. Pat. No. 8,109,816 (Issued on Feb. 7, 2012) wherein two acceleration sensors are used in performing swing analysis.

In the case of using such acceleration sensors, a golf ball has to be struck by a golfer to recognize the moment of impact, but in a relatively small indoor place, a safety device for golf ball striking should be installed.

In the case of using the acceleration sensor and the gyroscope sensor, furthermore, acceleration and angular velocity are sensed and processed with mathematical integration, and accordingly, there are limitations in compensating for accumulated errors, intrinsic noise of the sensors, bias noise, and the like.

Further, if the golf ball is not struck directly by the golfer, it is hard to accurately recognize the point of impact. In this case, the lowest point of a swing trajectory is utilized as a strike point, but since strike points are different according to types of clubs, there are limitations in practicing golf swings in consideration of such different strike points.

DISCLOSURE OF THE INVENTION

Technical Problems

Accordingly, the present invention has been made in view of the above-mentioned problems occurring in the related art, and it is an object of the present invention to provide a golf swing practice machine that is capable of allowing a position of impact to be accurately recognized by a golfer, even though the golfer does not directly strike a golf ball, and providing various swing element information such as a club speed, a face angle, and the like at the moment of impact to the golfer.

It is another object of the present invention to provide a golf swing practice machine that is capable of allowing a golfer to adjust different golf ball and feet positions according to types of clubs at the golfer's address.

It is yet another object of the present invention to provide a golf swing practice machine that is capable of combining light sensors and an IMU sensor with each other so that a start point of backswing, moment of impact, a club speed, a club face angle, tempo, and the like are measured through the light sensors.

It is still another object of the present invention to provide a golf swing practice machine that is configured to have an IMU sensor consisting of a 3-axis acceleration sensor and a 3-axis gyroscope sensor so that a club path, an attack angle, a swing plane, a dynamic loft, and the like are measured through the IMU sensor.

It is yet still another object of the present invention to provide a golf swing practice machine that is capable of combining light sensors and an IMU sensor with each other to calculate the instantaneous rotation center, a tempo or tempo ratio, and a club speed according to changes in length of a club at the moment of impact, so that based on the calculated results, club speed information corresponding to the length of the real club is calculated, irrespective of the length of a practice club.

It is another object of the present invention to provide a golf swing practice machine that is capable of utilizing an acceleration sensor, if lengths and lie angles of clubs are different according to types of the clubs, to allow a golfer to practice golf swings, when he or she addresses a golf ball, with a posture through which a similar lie angle to a real club is made.

The technical problems to be achieved through the present invention are not limited as mentioned above, and other technical problems not mentioned herein will be obviously understood by one of ordinary skill in the art through the following description.

Technical Solutions

To accomplish the above-mentioned objects, according to the present invention, there is provided a golf swing practice machine including: a club part 100 adapted to be swung by a golfer; a bottom part 200 on which a virtual golf ball 210 to be struck by the swing of the club part 100 is placed; and an application 300 for evaluating the state of the club part 100, when the golf ball placed on the bottom part 200 is struck, or selecting the type of a practice club, whereby the swing state of the club part 100 is analyzed.

Further, the club part 100 may include: a grip 120 held by the golfer's hands; a head unit 130 having a light receiver and a light transmitter adapted to display a position thereof; a shaft 110 for connecting the grip 120 and the head unit 130 to each other; and an acceleration sensor and a gyroscope sensor (IMU sensor) disposed at given positions thereof to determine position information thereof.

Further, the bottom part 200 may include: the virtual golf ball 210 disposed thereon; a backswing sensing means for sensing a backswing of the club part 100; and an impact sensing means for sensing the moment of impact on the virtual golf ball 210 after the club part 100 starts a downswing after the backswing.

Furthermore, the application 300 may include a controller 310, an operation module 320, an input part 330, a display part 340, and a storage part 350.

Besides, the backswing sensing means may include a first slit beam 232 irradiated vertically onto the bottom part 200 from a first light transmitter 222 disposed on the bottom part 200 and a light receiving sensor disposed on an underside 135 of the head unit 130 to receive the first slit beam 232, when the club part 100 starts the backswing, the light receiving sensor transmits a first sensing signal to the controller 310 at the moment when the first slit beam 232 is detected, and the controller 310 may determine a time point when the first sensing signal is received as a time point when the backswing is started and store the time point in the storage part 350.

Further, the impact sensing means may include a second slit beam 231 irradiated vertically onto the bottom part 200 from a second light transmitter 221 disposed on the bottom part 200 and light receiving sensors disposed on the underside 135 of the head unit 130 to receive the second slit beam 231, so that when the club part 100 starts the downswing, further, the light receiving sensors may transmit a second sensing signal to the controller 310 at the moment when the second slit beam 231 is detected, and the controller 310 may determine a time point when the second sensing signal is received as the moment of impact.

Furthermore, the velocity of the head unit 130 at the moment of impact may be measured as $Vh=k/\Delta t$ through the controller 310 receiving the first sensing signal and the second sensing signal that detect the first slit beam 232 and the second slit beam 231 from the light receiving sensors, when it is assumed that a time difference between the first sensing signal and the second sensing signal is $\Delta t$ and the shortest distance between the first slit beam 232 and the second slit beam 231 is K.

Besides, the number of light receiving sensors disposed on the underside 135 of the head unit 130 may be two, and the two light receiving sensors may be spaced apart from each other at the same distance from the center of the head unit 130, so that when the grip 120 of the club part 100 is held by the golfer's hands, the light receiving sensors may be arranged vertically to the golfer's body, and the light receiving sensor distant from the golfer may be a first light receiving sensor 131, whereas the light receiving sensor close to the golfer may be a second light receiving sensor 132.

Moreover, the application 300 may have a function of measuring a face angle at the moment of impact, and when it is assumed that a time point when the first light receiving sensor 131 recognizes the second slit beam 231 is ta, a time point when the second light receiving sensor 132 recognizes the second slit beam 231 is tb, a time difference between the ta and the tb is $\Delta ab$, and a straight line distance between the first light receiving sensor 131 and the second light receiving sensor 132 is d, the face angle at the moment of impact may be calculated to $$\alpha = \sin^{-1}\left(\frac{\Delta d}{d}\right) \text{ (wherein } \Delta d = Vh * \Delta ab\text{)}.$$

Besides, the display part 340 of the application 300 may display that the face angle is closed if the time point ta when the first light receiving sensor 131 recognizes the second slit beam 231 is faster than the time point tb when the second light receiving sensor 132 recognizes the second slit beam 231, display that the face angle is open if the time point ta is slower than the time point tb, and display that the face angle is square, together with an angle, if the time point ta is the same as the time point tb.

Further, the application 300 may have a function of selecting types of clubs, and if a type of club is determined by the golfer, a lie angle may be determined according to the determined type of club, so that if an address operation is performed by the golfer to hold the grip 120 and change the angle of the grip 120 by adjusting the angles of his or her wrists, the operation module 320, which receives the output values from the acceleration sensor and the gyroscope sensor, may calculate the lie angle to allow the calculated lie angle to be displayed on the display part 340 of the application 300, and if the calculated lie angle is the same as the lie angle of the determined club, the display part 340 of the application 300 may display that the lie angle is set as the lie angle of the determined club.

Further, the application 300 may calculate a swing plane, a club angle, and an attack angle of the club part 100 and display the calculated results on the display part 340, so that when it is assumed that an axial direction of the shaft of the club part 100 is a Z-axis, a direction of the head unit 130 moving toward the golf ball is a Y-axis, and a direction distant from the golfer is an X-axis, the space coordinates of the grip 120 may be defined as $X_s$, $Y_s$, and $Z_s$, and the space coordinates of a center point of the underside of the head unit 130 of the club part 100 as $X_h$, $Y_h$, and $Z_h$, and when it is assumed that the space coordinates of a center point of the underside of a virtual head 600 under the assumption that the head unit 130 has a golf ball impact and the head unit 130 is located close to the golf ball are defined as $X_{vh}$, $Y_{vh}$, and $Z_{vh}$, it may be determined that the center point of the underside of the head unit 130 of the club part 100 is spaced apart from the center point of the underside of the virtual head 600 by a distance b in the direction of the Z-axis.

Furthermore, as the golfer performs a swing with the club part 100, the operation module 320, which receives the output value of the IMU sensor at given time intervals, may operate the space trajectory of the grip 120, the space trajectory of the center point of the underside of the head unit, and the space trajectory of the center point of the underside of the virtual head, while including time information.

Besides, the application 300 may operate the space trajectory of the head unit 130, and next, if the coordinate value of the direction of the X-axis, before and after the time point of impact $t_{im}$ on the operated path of the head unit 130, is not changed, it may be determined that the swing is in a straight path; if the coordinate value is changed from a positive value to a negative value, it may be determined that the swing is in an out-to-in path; and if the coordinate value is changed from a negative value to a positive value, it may be determined that the swing is in an in-to-out path, so that the determined result is displayed on the display part 340 of the application 300.

Further, the application 300 may include the space trajectory of the head unit 130 and the time information for each space position, and accordingly, the application 300 may calculate time T_b consumed from the backswing to a top position, time T_t consumed from the top position to the time point of impact after the downswing, and the ratio of the time T-b to the time T-t and display the calculated results on the display part 340.

Furthermore, the club part 100 may include the synchronous light generator 141 disposed between the first light receiving sensor 131 and the second light receiving sensor 132 on the underside 135 of the head unit 130, and the bottom part 200 may include synchronous light receivers 241 between the first light transmitter 222 and the second light transmitter 221 to receive the light irradiated from the synchronous light generator 141 so that the club part 100 is set to start a movement.

Objects, characteristics and advantages of the present invention will be more clearly understood from the detailed description as will be described below and the attached drawings.

The terms used in the present invention are to be given their ordinary and customary meaning to a person of ordinary skill in the art, and are not to be limited to a special or customized meaning unless expressly so defined herein. It should be noted that the use of particular terminology when describing certain features or aspect of the disclosure should not be taken to imply that the terminology is being redefined herein to be restricted to include any specific characteristics of the features or aspects of the disclosure with which that terminology is associated.

Advantageous Effects of the Invention

According to the present invention, the golf swing practice machine allows a golfer's swing posture to be easily corrected to practice his or her golf swings, irrespective of indoor space sizes and ceiling heights.

Further, the golf swing practice machine according to the present invention allows the golfer to recognize the accurate moment of impact, even though he or she does not directly strike the golf ball, and measures a club speed, a club path, an attack angle, a face angle, and the like at the time point of impact to provide the measured information to him or her, so that the measured information is used to estimate the trajectory of the golf ball.

Further, the golf swing practice machine according to the present invention allows the start point of a backswing to be measured through direct light generated from the IMU sensor, thereby without having any complicated signal processing, performing the measurement more easily and more accurately.

Furthermore, the golf swing practice machine according to the present invention allows golf ball positions and feet positions at address to be connected with one another and adjusted according to types of clubs, thereby easily practicing golf swings.

Besides, the golf swing practice machine according to the present invention utilizes the acceleration sensor, if lengths and lie angles of clubs are different according to types of the clubs, to allow the golfer to practice taking a posture through which a similar lie angle to a real club is made at address.

Further, the golf swing practice machine according to the present invention calculates the instantaneous center of rotation at the moment of impact so that a club speed-based flight distance corresponding to the length of a real club shaft is estimated, thereby providing practice effects more similar to the practice effects with the real club.

The effectiveness of the invention is not limited as mentioned above, and it should be understood to those skilled in the art that the effectiveness of the invention may include another effectiveness as not mentioned above from the detailed description of the present invention.

BRIEF DESCRIPTION OF DRAWINGS

FIG. 5 is a plan view showing the golf swing practice machine according to the embodiment of the present invention, wherein FIG. 5*a* shows an underside of a head unit and FIG. 5*b* shows a bottom part.

MODE FOR INVENTION

Figure 1:
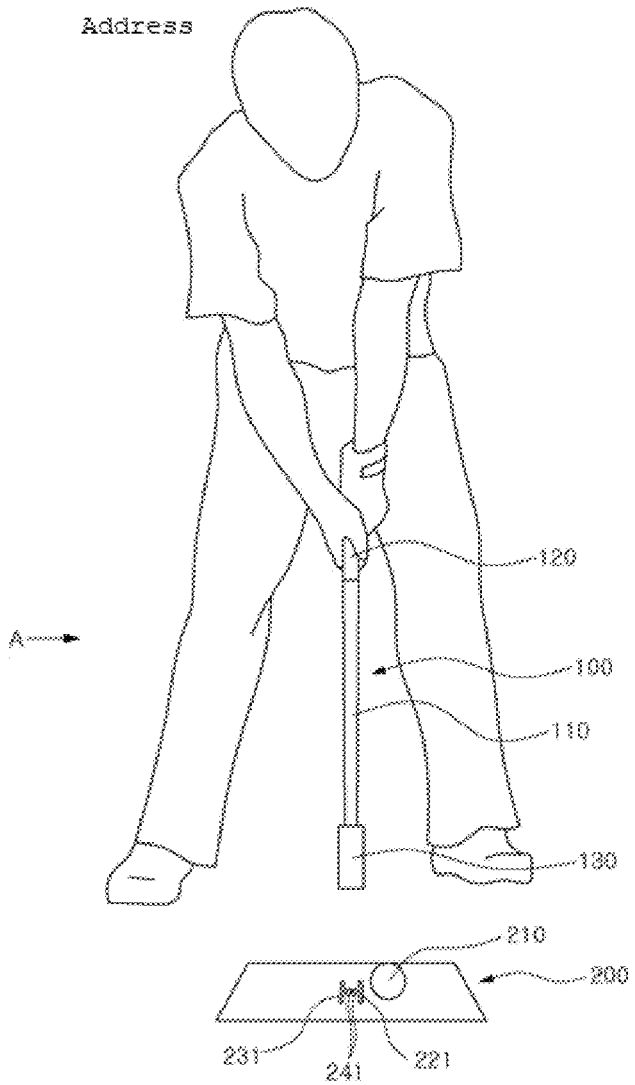
FIGS. 1 and 2 are perspective views showing a use state of a golf swing practice machine according to an embodiment of the present invention.

The present invention is disclosed with reference to the attached drawings wherein the thicknesses of the lines or the sizes of the components shown in the drawing may be magnified for the clarity and convenience of the description.

Further, the terms as will be discussed later are defined in accordance with the functions of the present invention, but may be varied under the intention or regulation of a golfer or operator. Therefore, they should be defined on the basis of the whole scope of the present invention.

The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

Figure 2:
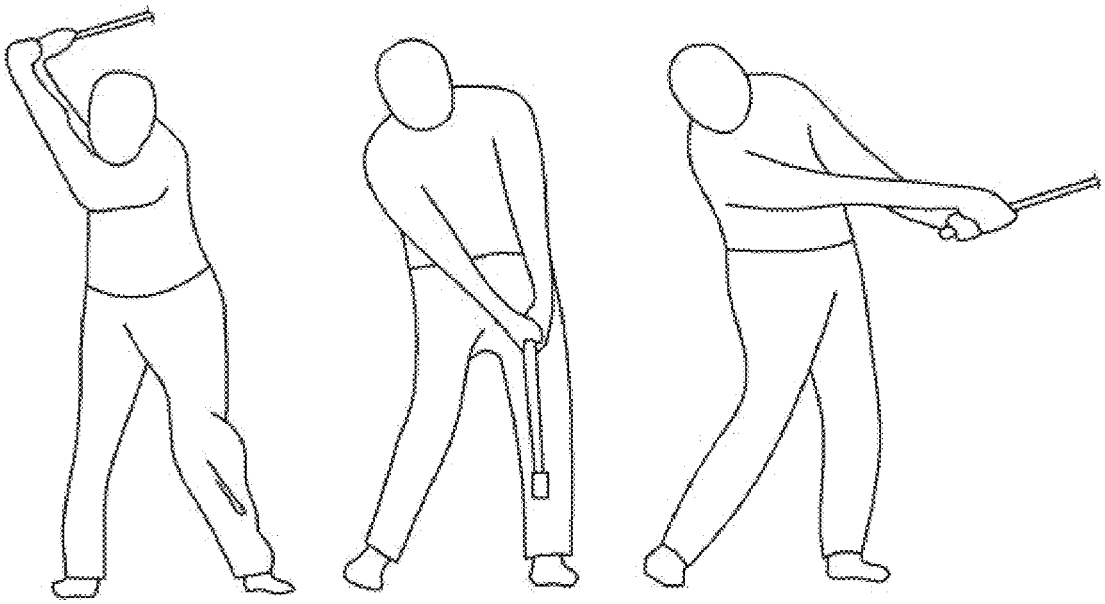
Figure 3:
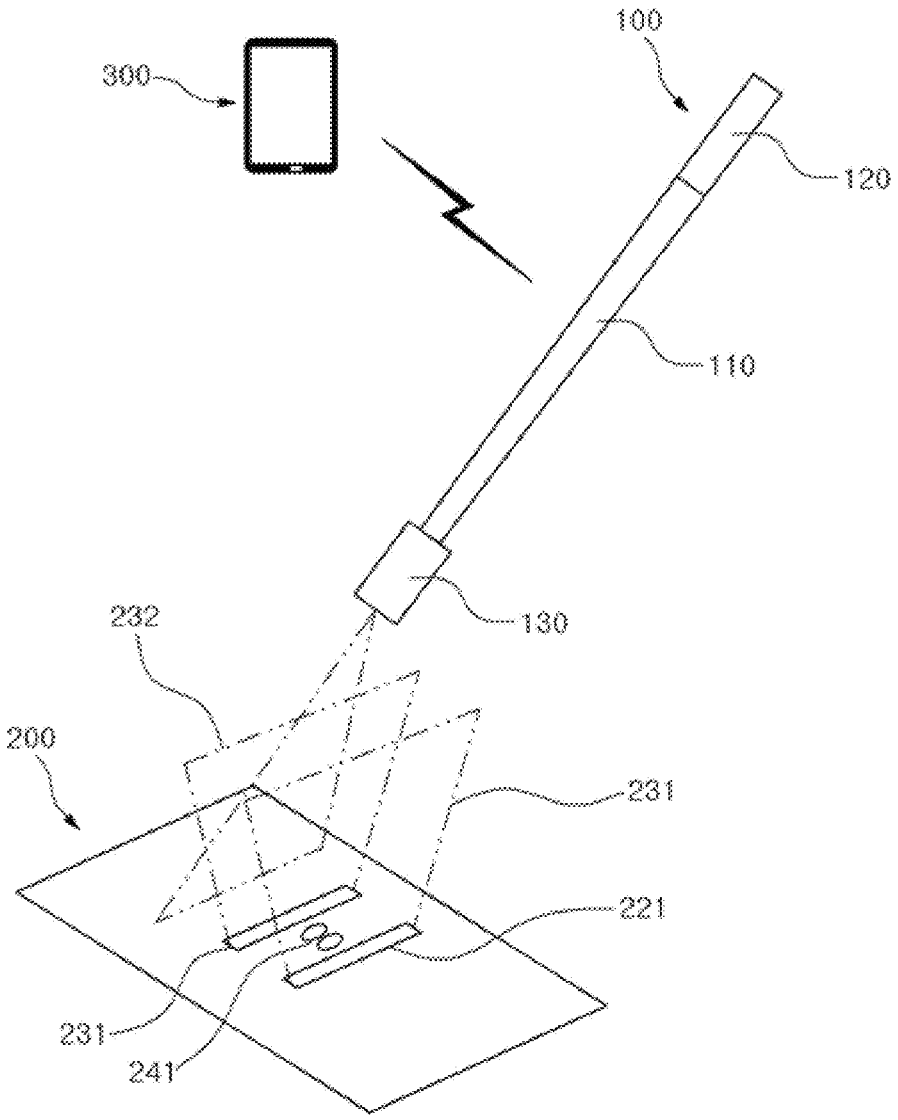
FIG. 3 is a schematic perspective view showing the golf swing practice machine according to the embodiment of the present invention.
Figure 4:
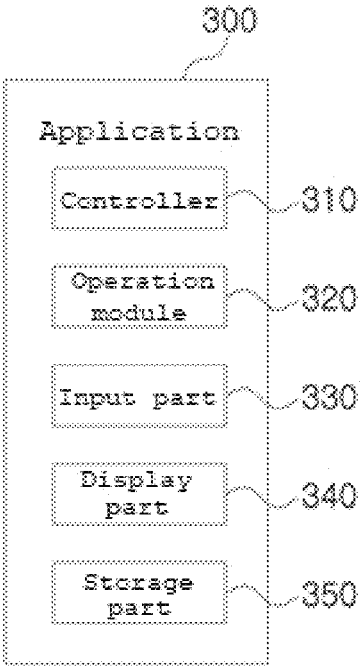
FIG. 4 is a schematic block diagram showing a configuration of an application of the golf swing practice machine according to the embodiment of the present invention.
Figure 5:
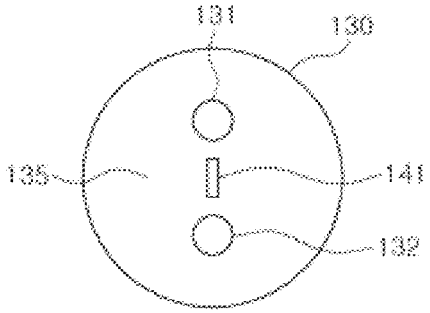
Figure 5:
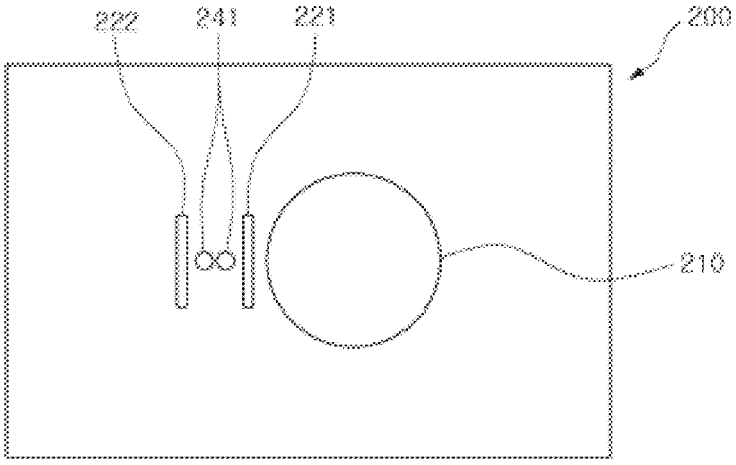
Figure 6:
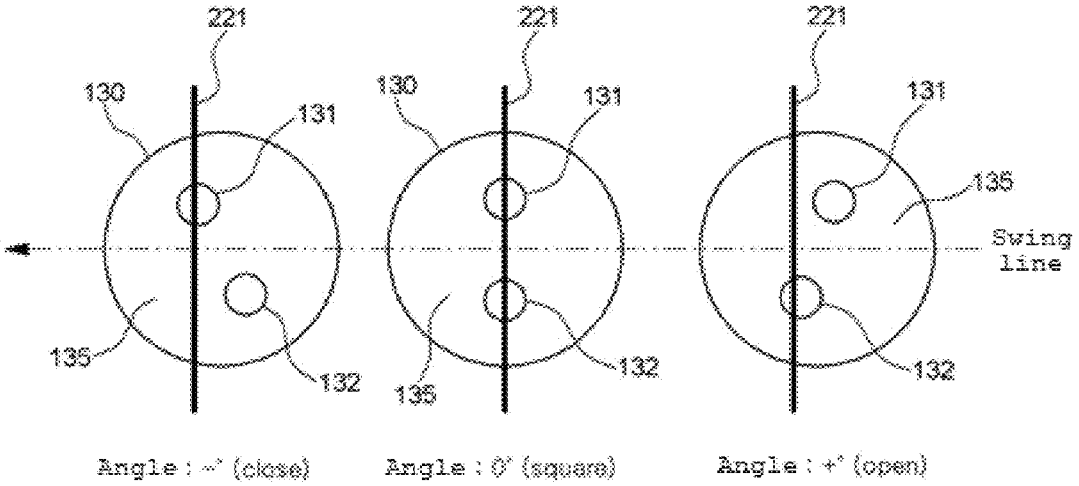
FIG. 6 is a plan view showing a method for measuring a face angle of the golf swing practice machine according to the embodiment of the present invention.
Figure 6:
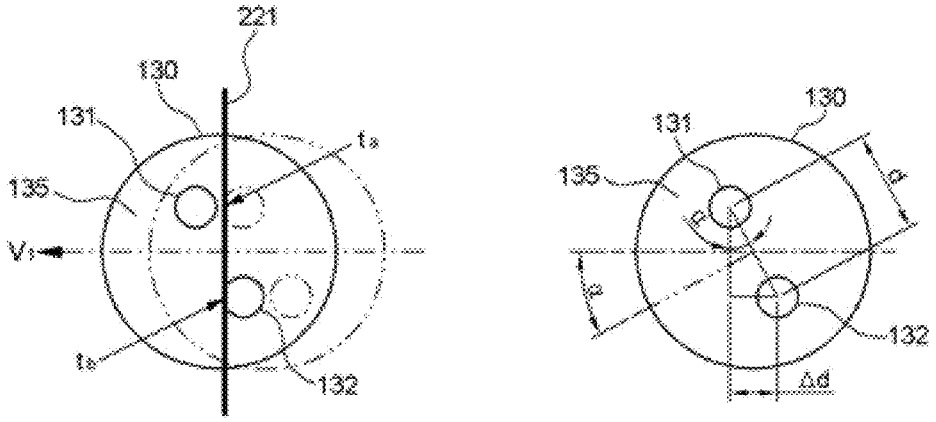
Figure 7:
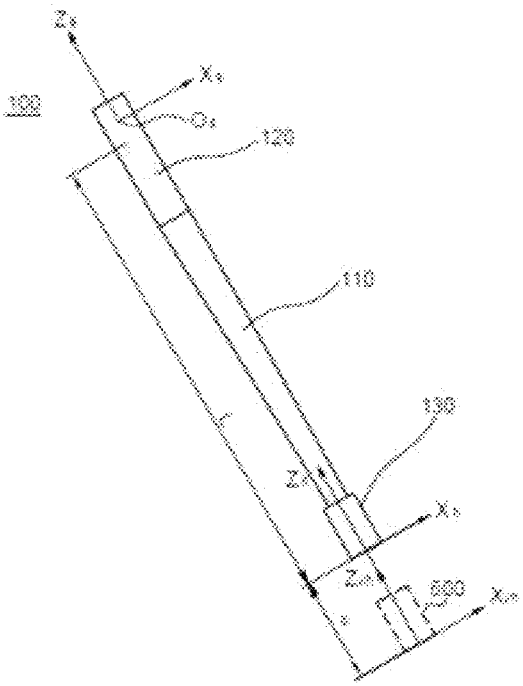
FIG. 7 is a view showing a method for setting a coordinate system of the golf swing practice machine according to the embodiment of the present invention.
Figure 7:
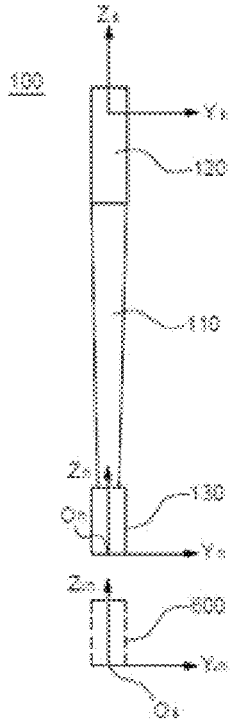
Figure 7:
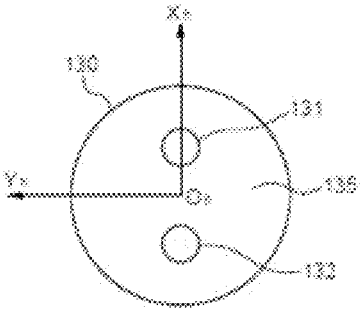
Figure 8:
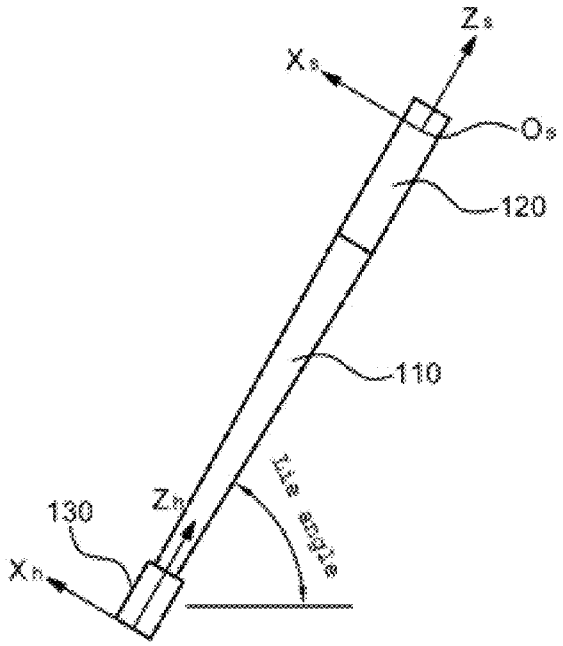
FIG. 8 is a side view showing a method for setting a lie angle of the golf swing practice machine according to the embodiment of the present invention.
Figure 9:
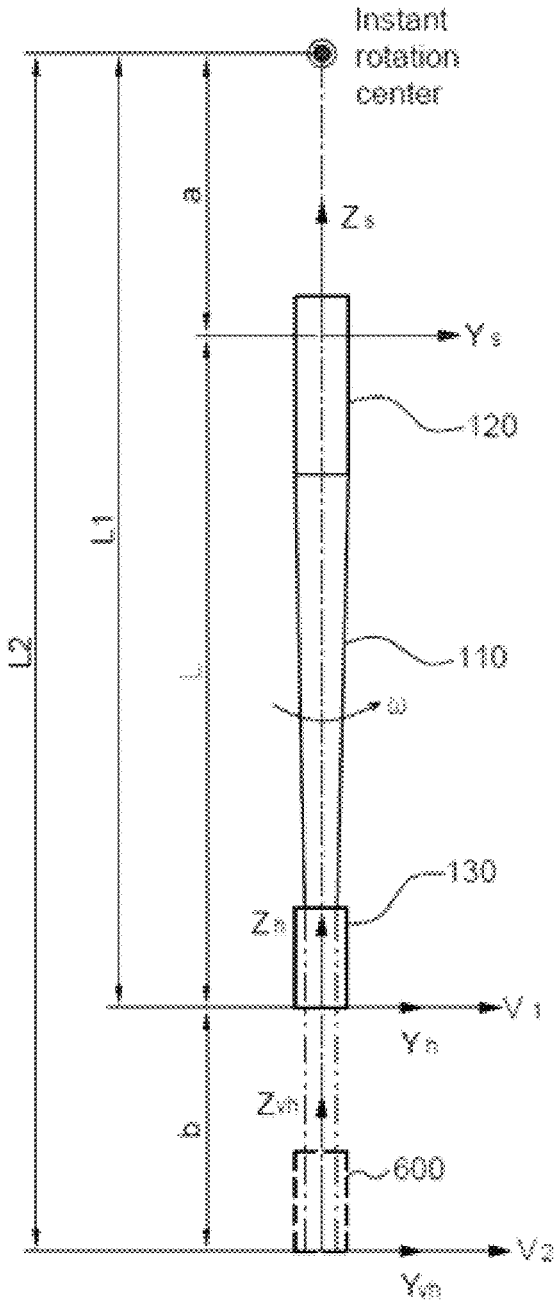
FIG. 9 is a view showing a method for calculating an instantaneous angular velocity and a club head speed of the golf swing practice machine according to the embodiment of the present invention.

FIGS. 1 and 2 are perspective views showing a use state of a golf swing practice machine according to an embodiment of the present invention, FIG. 3 is a schematic perspective view showing the golf swing practice machine according to the embodiment of the present invention, FIG. 4 is a schematic block diagram showing a configuration of an application of the golf swing practice machine according to the embodiment of the present invention, FIG. 5 is a plan view showing the golf swing practice machine according to the embodiment of the present invention, wherein FIG. 5*a* shows an underside of a head unit and FIG. 5*b* shows a bottom part, FIG. 6 is a plan view showing a method for measuring a face angle of the golf swing practice machine according to the embodiment of the present invention, FIG. 7 is a view showing a method for setting a coordinate system of the golf swing practice machine according to the embodiment of the present invention, FIG. 8 is a side view showing a method for setting a lie angle of the golf swing practice machine according to the embodiment of the present invention, and FIG. 9 is a view showing a method for calculating an instantaneous angular velocity and a club head speed of the golf swing practice machine according to the embodiment of the present invention.

The present invention relates to a golf swing practice machine, more specifically to a device and method for allowing a golfer to accurately recognize a striking position of a golf ball, even though the golfer does not strike the golf ball indoors and outdoors, and providing information such as attack angle, a club path, a face angle, a club speed, a tempo and tempo ratio, a swing plane, and the like at the moment of impact, thereby improving the swing practice effect.

Further, the present invention relates to a device and method for allowing the golfer to recognizing the instantaneous center of rotation through the club speed and the angular speed measured at the moment of impact to provide club speeds according to various lengths of clubs, thereby helping him or her estimate the flight distances by club.

Furthermore, the present invention relates to a device and method for allowing the golfer to practice his or her golf swings with various lie angles set according to clubs.

As shown in FIGS. 1 to 9, a golf swing practice machine according to the present invention includes: a club part 100 adapted to be swung by a golfer; a bottom part 200 on which a golf ball to be struck by the swing of the club part 100 is placed; and an application 300 for evaluating the state of the club part 100, when the golf ball placed on the bottom part 200 strikes, or selecting the type of a practice club, whereby the swing state of the club part 100 is analyzed.

The club part 100 includes a grip 120 held by the golfer's hands, a head unit 130 having a light receiver or a light transmitter adapted to display a position thereof, and a shaft 110 for connecting the grip 120 and the head unit 130 to each other.

Further, the club part 100 has an acceleration sensor and a gyroscope sensor (IMU sensor) disposed at given positions thereof to determine position information thereof.

The bottom part 200 has the virtual golf ball 210 disposed thereon, a backswing sensing means for sensing a backswing of the club part 100, and an impact sensing means for sensing the moment of impact on the virtual golf ball 210 after the club part 100 starts a downswing after the backswing.

Further, the application 300 includes a controller 310, an operation module 320, an input part 330, a display part 340, and a storage part 350.

Further, the backswing sensing means includes a first slit beam 232 irradiated vertically onto the bottom part 200 from a first light transmitter 222 disposed on the bottom part 200 and a light receiving sensor disposed on an underside 135 of the head unit 130 to receive the first slit beam 232.

When the club part 100 starts the backswing, the light receiving sensor transmits a first sensing signal to the controller 310 at the moment when the first slit beam 232 is detected, and the controller 310 determines a time point when the first sensing signal is received as a time point when the backswing is started and stores the time point in the storage part 350.

Further, the impact sensing means includes a second slit beam 231 irradiated vertically onto the bottom part 200 from a second light transmitter 221 disposed on the bottom part 200 and light receiving sensors disposed on the underside 135 of the head unit 130 to receive the second slit beam 231.

When the club part 100 starts the downswing, further, the light receiving sensors transmit a second sensing signal to the controller 310 at the moment when the second slit beam 231 is detected, and the controller 310 determines a time point when the second sensing signal is received as the moment of impact.

Further, the golf swing practice machine measures the velocity of the head unit 130 at the moment of impact, and the controller 310, which receives the first sensing signal and the second sensing signal that detect the first slit beam 232 and the second slit beam 231 from the light receiving sensors, defines the velocity of the head unit 130 at the moment of impact as $Vh=k/\Delta t$, when it is assumed that a time difference between the first sensing signal and the second sensing signal is $\Delta t$ and the shortest distance between the first slit beam 232 and the second slit beam 231 is K.

Further, the golf swing practice machine further includes an impact alarming means through which impact is checked at the moment when the moment of impact is sensed by the controller 310.

Further, the impact alarming means generates an alarm sound through the application 300 or has an oscillator disposed on a given position of the club part 100 in such a way as to operate for a given period of time.

The number of light receiving sensors disposed on the underside 135 of the head unit 130 is two, and the two light receiving sensors are spaced apart from each other at the same distance from the center of the head unit 130.

When the grip 120 of the club part 100 is held by the golfer's hands, the light receiving sensors are arranged vertically to the golfer's body. The light receiving sensor distant from the golfer is a first light receiving sensor 131, whereas the light receiving sensor close to the golfer is a second light receiving sensor 132.

Further, the application 300 has a function of measuring a face angle at the moment of impact. In detail, when it is assumed that a time point when the first light receiving sensor 131 recognizes the second slit beam 231 is ta, a time point when the second light receiving sensor 132 recognizes the second slit beam 231 is tb, a time difference between the ta and the tb is Δab, and a straight line distance between the first light receiving sensor 131 and the second light receiving sensor 132 is d, the face angle at the moment of impact is desirably calculated to $$\alpha = \sin^{-1}\left(\frac{\Delta d}{d}\right) \text{ (wherein } \Delta d = Vh * \Delta ab\text{)}.$$

Further, the display part 340 of the application 300 displays that the face angle is closed if the time point ta when the first light receiving sensor 131 recognizes the second slit beam 231 is faster than the time point tb when the second light receiving sensor 132 recognizes the second slit beam 231, and displays that the face angle is open if the time point ta is slower than the time point tb, and displays that the face angle is square, together with an angle, if the time point ta is the same as the time point tb.

Further, the application 300 has a function of selecting types of clubs to practice a golf swing with the selected club.

If the type of club is determined by the golfer, a lie angle is determined according to the determined type of club, and if the golfer's address is performed, while he or she holds the grip 120 and changes the angle of the grip 120 by adjusting the angles of his or her wrists, the operation module 320, which receives the output values from the acceleration sensor and the gyroscope sensor, calculates the lie angle to allow the calculated lie angle to be displayed on the display part 340 of the application 300.

If the calculated lie angle is the same as the lie angle of the determined club, the display part 340 of the application 300 displays that the lie angle is set as the lie angle of the determined club.

Referring to FIG. 7, the application 300 calculates a swing plane, a club angle, and an attack angle of the club part 100 and displays the calculated results on the display part 340.

When it is assumed that an axial direction of the shaft of the club part 100 is a Z-axis, a direction of the head unit moving toward the golf ball is a Y-axis, and a direction distant from the golfer is an X-axis, the space coordinates of the grip 120 are defined as $X_s$, $Y_s$, and $Z_s$, and the space coordinates of a center point of the underside of the head unit 130 of the club part 100 as $X_h$, $Y_h$, and $Z_h$.

When it is assumed that the space coordinates of a center point of the underside of a virtual head 600 where it is assumed that the head unit 130 is located close to the golf ball under the assumption that the head unit 130 has a golf ball impact are defined as $X_{vh}$, $Y_{vh}$, and $Z_{vh}$, it is determined that the center point of the underside of the head unit of the club part 100 is spaced apart from the center point of the underside of the virtual head 600 by a distance b in the direction of the Z-axis.

In this case, if the type of club (e.g., iron, wood, sand, driver, and the like) is determined by the golfer, the lie angle is determined according to the determined type of club, and the golfer adjusts the angles of his or her wrists and sets the lie angle, while allowing the light irradiated from a synchronous light generator 141 to be transmitted to a synchronous light receiver 241.

In a state of the golfer's address, so as to allow him or her to set the lie angle, while allowing the light irradiated from the synchronous light generator 141 to be transmitted to the synchronous light receiver 241 (that is, while allowing the synchronous light generator 141 and the synchronous light receiver 241 to face each other in a straight line), a distance between a position of the synchronous light generator 141 and a position where he or she stands up has to be adjusted.

To set the lie angle according to the determined type of club, the golfer has to allow the light irradiated from the synchronous light generator 141 to be transmitted to the synchronous light receiver 241, and accordingly, the golfer determines the position where he or she stands up according to the position of the synchronous light generator 141.

Further, the length of the shaft becomes varied according to the determined type of club, and accordingly, the distance b in the direction of the Z-axis from the center point of the underside of the head unit of the club part 100 to the center point of the underside of the virtual head 600 is differently determined according to the determined type of club.

That is, if the type of club is determined by the golfer, the golfer adjusts the lie angle, while allowing the light irradiated from the synchronous light generator 141 to be transmitted to the synchronous light receiver 241, and to do this, the golfer adjusts his or her standing position according to the position of the synchronous light generator 141.

If the type of club is determined by the golfer, further, the length of the shaft becomes varied according to the determined type of club, and accordingly, the distance b in the direction of the Z-axis from the center point of the underside of the head unit of the club part 100 to the center point of the underside of the virtual head 600 is set according to the determined type of club.

If so, a straight line distance between the synchronous light generator 141 and the synchronous light receiver 241 becomes the distance b in the direction of the Z-axis from the head unit of the club part 100 to the virtual head 600, and to perform accurate distance measurement, a separate distance measurement sensor is needed, while the synchronous light generator 141 generates point light (straight line light), not slit light.

In this case, a time-of-flight (ToF) sensor or ultrasonic sensor may be used as the distance measurement sensor.

Further, the golf swing practice machine according to the present invention is provided with the IMU sensor having the 3-axis acceleration sensor and the 3-axis gyroscope sensor built therein so that at the moment when the virtual head strikes the golf ball, the angular velocity and instantaneous center of rotation (as shown in FIG. 9) are obtained, thereby calculating a velocity V1 of the head unit 130 and a velocity V2 of the virtual head 600 of the golf swing practice machine through the IMU sensor.

When the golfer performs a golf swing with the golf swing practice machine according to the present invention, the virtual head 600 accurately recognizes a strike point on the golf ball at the moment when the virtual head 600 strikes the golf ball, thereby providing very beneficial information to the golfer.

Figure 10:
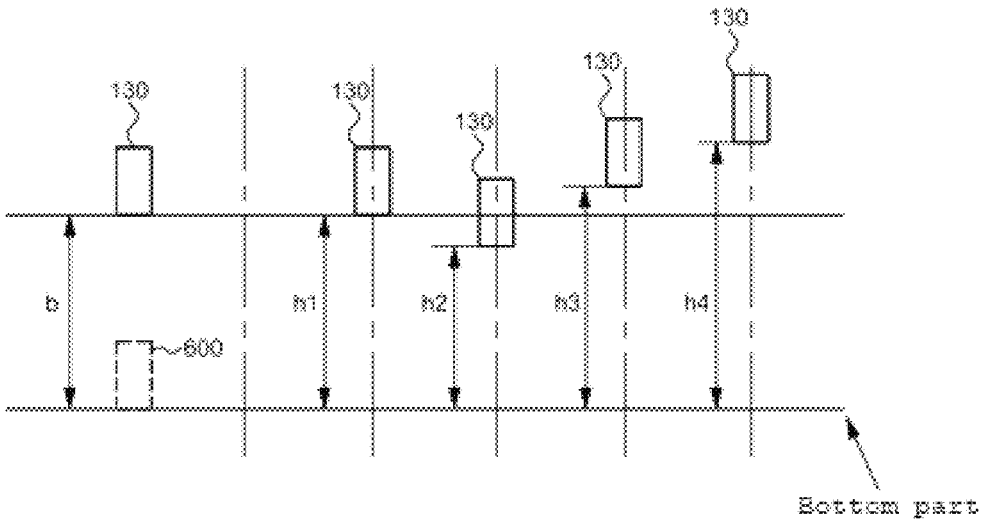
FIGS. 10 and 11 are views showing a process where a virtual head checks a striking point of a golf ball through a position of the underside of the head unit at the moment when the golf ball is struck.

When it is assumed that a distance between the center line of the underside of the head unit 130 and the center line of the underside of the virtual head 600 is b, FIG. 10 shows a process where a strike point on the golf ball of the virtual head 600 is checked through the positions of the underside of the head unit 130 at the moment when the virtual head 600 strikes the golf ball.

Figure 11:
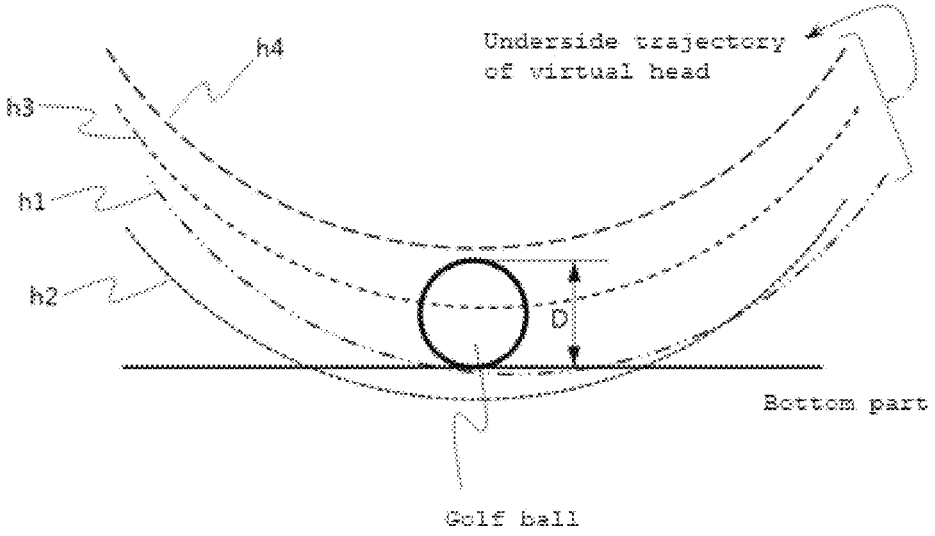

Referring to FIGS. 10 and 11, it is checked that the underside of the virtual head accurately strikes the underside of the golf ball 210 (See the trajectory of h1 of the underside of the virtual head of FIG. 11) when the distance H=h1 between the underside 135 of the head unit 130 and the bottom part 200 is b (h1=b) (See the second figure of the left side of FIG. 10) at the moment when the virtual head 600 strikes the golf ball, so that accurate striking is performed.

Further, it is checked that the underside of the virtual head strikes the floor behind the golf ball 210 (See the trajectory of h2 of the underside of the virtual head of FIG. 11) when the distance H=h2 between the underside 135 of the head unit 130 and the bottom part 200 is shorter than b (h2<b) (See the third figure of the left side of FIG. 10) at the moment when the virtual head 600 strikes the golf ball, so that accurate striking is not performed.

Furthermore, it is checked that the underside of the virtual head strikes the upper portion of the golf ball 210 (See the trajectory of h3 of the underside of the virtual head of FIG. 11) when the distance H=h3 between the underside 135 of the head unit 130 and the bottom part 200 is longer than b and shorter than b+D(b<h3<b+D) (See the fourth figure of the left side of FIG. 10) at the moment when the virtual head 600 strikes the golf ball having a diameter of D, so that the upper portion of the golf ball is struck.

Besides, it is checked that the underside of the virtual head passes over the golf ball 210 (See the trajectory of h4 of the underside of the virtual head of FIG. 11) when the distance H=h4 between the underside 135 of the head unit 130 and the bottom part 200 is longer than b+D(b+D<h4) (See the fifth figure of the left side of FIG. 10) at the moment when the virtual head 600 strikes the golf ball, so that the golf ball is not struck at all.

Through the trajectory information of the underside of the virtual head, the striking point of the golf ball is checked, so that the flight distance of the golf ball can be estimated.

As the golfer performs a swing with the club part 100, further, the operation module 320, which receives the output value of the IMU sensor at given time intervals, operates the space trajectory of the grip 120, the space trajectory of the center point of the underside of the head unit, and the space trajectory of the center point of the underside of the virtual head, while including time information.

In this case, the center point represents a center point when it is assumed that the underside is a circular plane.

Further, the application 300 operates the space trajectory of the head unit 130, and next, if the coordinate value of the direction of the X-axis, before and after the time point of impact $t_{im}$ on the operated path of the head unit 130, is not changed, it is determined that the swing is in a straight path. If the coordinate value is changed from a positive value to a negative value, it is determined that the swing is in an out-to-in path, whereas if the coordinate value is changed from a negative value to a positive value, it is determined that the swing is in an in-to-out path. As a result, the determined result is displayed on the display part 340 of the application 300.

Further, the application 300 includes the space trajectory of the head unit 130 and the time information for each space position, and accordingly, the application 300 displays a tempo ratio of time T_b consumed from the backswing to a top position to time T_t consumed from the top position to the time point of impact after the downswing and tempo information as the sum of the time T_b and the time T_t on the display part 340.

Further, the club part 100 includes the synchronous light generator 141 disposed between the first light receiving sensor 131 and the second light receiving sensor 132 on the underside 135 of the head unit 130.

Further, the bottom part 200 includes synchronous light receivers 241 between the first light transmitter 222 and the second light transmitter 221 to receive the light irradiated from the synchronous light generator 141 so that the club part 100 is set to start a movement.

To allow the golf swing address to be more visibly performed conveniently, that is, the golf swing practice machine according to the present invention is configured to allow the synchronous light generator 141 of the head unit 130 to irradiate slit type light or club-shaped light onto the bottom part 200 in such a way as to permit the light to be focusedly received between the two synchronous light receivers 241. A signal through which the reception of the light is recognized is displayed, and from that time, the second light transmitter 221 and the first light transmitter 222 start to transmit the light therefrom.

Further, the synchronous light generator 141 makes use of an LED diode or laser diode emitting visible light recognized by humans.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings.

It is therefore intended that the scope of the invention be limited not by this detailed description, but rather by the claims appended hereto.

[Explanations of Reference Numerals]

100: Club part
110: Shaft
120: Grip
130: Head unit
135: Underside
141: Synchronous light generator
200: Bottom part
210: Golf ball
221: Second light transmitter
222: First light transmitter
231: Second slit beam
232: First slit beam
241: Synchronous light receiver
300: Application
310: Controller
320: Operation module
330: Input part
340: Display part
350: Storage part

The invention claimed is:

1. A golf swing practice machine comprising:

a club part (100) adapted to be swung by a golfer;

a bottom part (200) on which a virtual golf ball (210) to be struck by the swing of the club part (100) is placed; and an application (300) for evaluating the state of the club part (100), when the golf ball placed on the bottom part (200) is struck, or selecting the type of a practice club, whereby the swing state of the club part (100) is analyzed, wherein the club part (100) comprises:

a grip (120) held by the golfer's hands;

a head unit (130) having a light receiver and a light transmitter adapted to display a position thereof;

a shaft (110) for connecting the grip (120) and the head unit (130) to each other; and an inertial measurement unit (IMU) including an acceleration sensor and a gyroscope sensor, the IMU being disposed at given positions thereof to determine position information thereof, wherein the bottom part (200) comprises:

the virtual golf ball (210) disposed thereon;

a backswing sensing means for sensing a backswing of the club part (100); and an impact sensing means for sensing a moment of impact on the virtual golf ball (210) after the club part (100) starts to perform a downswing after the backswing, wherein the application (300) comprises a controller (310), an operation module (320), an input part (330), a display part (340), and a storage part (350), and wherein the backswing sensing means comprises a first slit beam (232) irradiated vertically onto the bottom part (200) from a first light transmitter (222) disposed on the bottom part (200) and a light receiving sensor disposed on an underside (135) of the head unit (130) to receive the first slit beam (232), so that when the club part (100) starts the backswing, the light receiving sensor transmits a first sensing signal to the controller (310) at the moment when the first slit beam (232) is detected, and the controller (310) determines a time point when the first sensing signal is received as a time point when the backswing is started and stores the time point in the storage part (350).

2. The golf swing practice machine according to claim 1, wherein the impact sensing means comprises a second slit beam (231) irradiated vertically onto the bottom part (200) from a second light transmitter (221) disposed on the bottom part (200) and light receiving sensors disposed on the underside (135) of the head unit (130) to receive the second slit beam (231), so that when the club part (100) starts the downswing, the light receiving sensors transmit a second sensing signal to the controller (310) at the moment when the second slit beam (231) is detected, and the controller (310) determines a time point when the second sensing signal is received as the moment of impact.

3. The golf swing practice machine according to claim 1, wherein a velocity of the head unit (130) at the moment of impact is measured as $Vh=k/\Delta t$ through the controller (310) receiving the first sensing signal and the second sensing signal that detect the first slit beam (232) and the second slit beam (231) from the light receiving sensors, when it is assumed that a time difference between the first sensing signal and the second sensing signal is $\Delta t$ and the shortest distance between the first slit beam (232) and the second slit beam (231) is K.

4. The golf swing practice machine according to claim 3, wherein the number of light receiving sensors disposed on the underside (135) of the head unit (130) is two, and the two light receiving sensors are spaced apart from each other at the same distance from the center of the head unit (130), so that when the grip (120) of the club part (100) is held by the golfer's hands, the light receiving sensors are arranged vertically to the golfer's body, and the light receiving sensor distant from the golfer is a first light receiving sensor (131), whereas the light receiving sensor close to the golfer is a second light receiving sensor (132).

5. The golf swing practice machine according to claim 4, wherein the application (300) has a function of measuring a face angle at the moment of impact, and when it is assumed that a time point when the first light receiving sensor (131) recognizes the second slit beam (231) is ta, a time point when the second light receiving sensor (132) recognizes the second slit beam (231) is tb, a time difference between the ta and the tb is Aab, and a straight line distance between the first light receiving sensor (131) and the second light receiving sensor (132) is d, the face angle at the moment of impact is calculated to $\alpha=\sin^{-1}(\Delta d/d)$ (wherein $\Delta d=Vh*\Delta ab$).

6. The golf swing practice machine according to claim 5, wherein the display part (340) of the application (300) displays that the face angle is closed if the time point ta when the first light receiving sensor (131) recognizes the second slit beam (231) is faster than the time point tb when the second light receiving sensor (132) recognizes the second slit beam (231), displays that the face angle is open if the time point ta is slower than the time point tb, and displays that the face angle is square, together with an angle, if the time point ta is the same as the time point tb.

7. The golf swing practice machine according to claim 2, wherein the application (300) has a function of selecting types of clubs, and if a type of club is determined by the golfer, a lie angle is determined according to the determined type of club, so that if an address operation is performed by the golfer to hold the grip (120) and change the angle of the grip (120) by adjusting the angles of his or her wrists, the operation module (320), which receives the output values from the acceleration sensor and the gyroscope sensor, calculates the lie angle to allow the calculated lie angle to be displayed on the display part (340) of the application (300), and if the calculated lie angle is the same as the lie angle of the determined club, the display part (340) of the application (300) displays that the lie angle is set as the lie angle of the determined club.

8. The golf swing practice machine according to claim 7, wherein the application (300) calculates a swing plane, a club angle, and an attack angle of the club part (100) and displays the calculated results on the display part (340), so that when it is assumed that an axial direction of the shaft of the club part (100) is a Z-axis, a direction of the head unit (130) moving toward the golf ball is a Y-axis, and a direction distant from the golfer is an X-axis, the space coordinates of the grip (120) are defined as $X_s$, $Y_s$, and $Z_s$, and the space coordinates of a center point of the underside of the head unit (130) of the club part (100) as $X_h$, $Y_h$, and $Z_h$, and when it is assumed that the space coordinates of a center point of the underside of a virtual head (600) under the assumption that the head unit (130) has a golf ball impact and the head unit (130) is located close to the golf ball are defined as $X_{vh}$, $Y_{vh}$, and $Z_{vh}$, it is determined that the center point of the underside of the head unit (130) of the club part (100) is spaced apart from the center point of the underside of the virtual head (600) by a distance b in the direction of the Z-axis.

9. The golf swing practice machine according to claim 8, wherein as the golfer performs a swing with the club part (100), the operation module (320), which receives the output value of the IMU at given time intervals, operates a space trajectory of the grip (120), the space trajectory of the center point of the underside of the head unit (130), and the space trajectory of the center point of the underside of the virtual head (600), while including time information.

10. The golf swing practice machine according to claim 9, wherein the application (300) operates the space trajectory of the head unit (130), and next, if the coordinate value of the direction of the X-axis, before and after the time point of impact $t_{im}$ on the operated path of the head unit (130), is not changed, it is determined that the swing is in a straight path; if the coordinate value is changed from a positive value to a negative value, it is determined that the swing is in an out-to-in path; and if the coordinate value is changed from a negative value to a positive value, it is determined that the swing is in an in-to-out path, so that the determined result is displayed on the display part (340) of the application (300).

* * * * *